US011112149B2

(12) United States Patent
Nishida

(10) Patent No.: US 11,112,149 B2
(45) Date of Patent: Sep. 7, 2021

(54) HEAT EXCHANGER AND AIR-CONDITIONING APPARATUS

(71) Applicant: Mitsubishi Electric Corporation, Tokyo (JP)

(72) Inventor: Takuro Nishida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 52 days.

(21) Appl. No.: 16/473,684

(22) PCT Filed: Mar. 9, 2017

(86) PCT No.: PCT/JP2017/009568
§ 371 (c)(1),
(2) Date: Jun. 26, 2019

(87) PCT Pub. No.: WO2018/163373
PCT Pub. Date: Sep. 13, 2018

(65) Prior Publication Data

US 2019/0383531 A1 Dec. 19, 2019

(51) Int. Cl.
*F25B 39/02* (2006.01)
*F25B 39/00* (2006.01)
*F28F 9/02* (2006.01)

(52) U.S. Cl.
CPC ..... *F25B 39/00* (2013.01); *F28F 9/0275* (2013.01); *F25B 39/028* (2013.01)

(58) Field of Classification Search
CPC ..... F25B 39/00; F25B 39/028; F28F 9/0275; F28F 9/027; F28F 9/026; F28F 9/26
(Continued)

(56) References Cited

U.S. PATENT DOCUMENTS 4,089,368 A * 5/1978 Bell, Jr. ..... F25B 39/02 165/139
6,142,220 A 11/2000 Motegi et al.
2015/0362222 A1* 12/2015 Matsuda ..... F25B 13/00

FOREIGN PATENT DOCUMENTS

CN 101086352 A 12/2007
EP 2 955 464 A1 12/2015
(Continued)

OTHER PUBLICATIONS

Office Action dated Aug. 28, 2020 issued in corresponding CN patent application No. 201780084922.7 (and English translation).
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

A heat exchanger includes a plate-shaped fin elongated in a longitudinal direction, a plurality of heat transfer tubes passing through the fin, and a distributor that distributes refrigerant to, from among the plurality of heat transfer tubes, two heat transfer tubes. The distributor includes an inflow portion being linear and connected to one of the plurality of heat transfer tubes, a turn-back portion continuous with the inflow portion, a first outflow portion being linear, continuous with the turn-back portion and running in parallel to the inflow portion, a second outflow portion being linear, continuous with the turn-back portion and branching from the first outflow portion, and a connection pipe continuous with the second outflow portion and including a plurality of bent portions. The second outflow portion is connected via the connection pipe to the heat transfer tube not adjacent to the heat transfer tube connected to the first outflow portion.

5 Claims, 5 Drawing Sheets

(58) Field of Classification Search
USPC ..... 285/331
See application file for complete search history.

(56) References Cited

FOREIGN PATENT DOCUMENTS

| | | | | |
|---|---|---|---|---|
| JP | 2010-133644 | A | 6/2010 | |
| JP | 5957538 | B2 * | 7/2016 | ..... F25B 39/028 |
| TW | 201430300 | A | 8/2014 | |
| WO | 2014/083651 | A1 | 6/2014 | |

OTHER PUBLICATIONS

International Search Report of the International Searching Authority dated May 30, 2017 for the corresponding international application No. PCT/JP2017/009568 (and English translation).
Extended European Search Report dated Feb. 10, 2020 issued in corresponding EP patent application No. 17899495.0.

* cited by examiner

HEAT EXCHANGER AND AIR-CONDITIONING APPARATUS

CROSS REFERENCE TO RELATED APPLICATION

This application is a U.S. national stage application of International Application No. PCT/JP2017/009568, filed on Mar. 9, 2017, the contents of which are incorporated herein by reference.

TECHNICAL FIELD

The present invention relates to a heat exchanger including a distributor that distributes refrigerant and an air-conditioning apparatus including the heat exchanger.

BACKGROUND

A heat exchanger used in an air-conditioning apparatus that includes a refrigerant circuit serves as a condenser or an evaporator depending on the flow of refrigerant. In such a heat exchanger, a technique in which a refrigerant path is branched into a plurality of paths is employed as a measure for reducing pressure loss of refrigerant and improving heat-exchanging efficiency. When a refrigerant path is branched into a plurality of paths, a distributor is commonly used near a refrigerant inlet of the heat exchanger. For example, Patent Literature 1 discloses using a cross-sectionally Y-shaped distributor to branch one flow path of refrigerant into a plurality of (six) paths. A distributor is also called a joint.

PATENT LITERATURE

Patent Literature 1: Japanese Unexamined Patent Application Publication No. 2010-133644

In the distributor in Patent Literature 1, handling of an inflow pipe (upstream pipe) and an outflow pipe (branching pipe) is required, which requires ensuring a space increased for the handling. That is, a space increased for handling of the pipes at the front and rear of the distributor is required, which increases the size of an air-conditioning apparatus (for example, a load-side unit, such as an indoor unit or other similar units) on which a heat exchanger is mounted.

There is another problem that distribution performance may be changed depending on an attachment angle of a distributor.

SUMMARY

The present invention is developed to overcome the aforementioned problem, and an object of the present invention is to provide a heat exchanger including a distributor that does not require an increased installation space and that suppresses distribution efficiency from decreasing, and an air-conditioning apparatus including the heat exchanger.

A heat exchanger according to an embodiment of the present invention includes a plate-shaped fin being elongate in a longitudinal direction thereof; a plurality of heat transfer tubes passing through the fin; and a distributor configured to distribute refrigerant to, from among the plurality of heat transfer tubes, two heat transfer tubes, the distributor including an inflow portion being linear and connected to one of the heat transfer tubes, a turn-back portion continuous with the inflow portion, a first outflow portion being linear, continuous with the turn-back portion and running in parallel to the inflow portion, a second outflow portion being linear, continuous with the turn-back portion and branching from the first outflow portion, and a connection pipe continuous with the second outflow portion and including a plurality of bent portions, the second outflow portion being connected via the connection pipe to an other one of the heat transfer tubes not adjacent to the one of the heat transfer tubes connected to the first outflow portion.

An air-conditioning apparatus according to an embodiment of the present invention is an air-conditioning apparatus that uses the aforementioned heat exchanger as an indoor heat exchanger.

The heat exchanger according to an embodiment of the present invention requires a less pipe handling space due to the provision of the distributor including the connection pipe and is capable of properly adjusting the distribution amount of refrigerant.

The air-conditioning apparatus according to an embodiment of the present invention does not increase, due to the aforementioned heat exchanger being used as an indoor heat exchanger, the size of a load-side unit as a result of installation of the aforementioned heat exchanger and improves heat exchanging efficiency due to the provision of the aforementioned heat exchanger.

DETAILED DESCRIPTION

Embodiment

Figure 1:
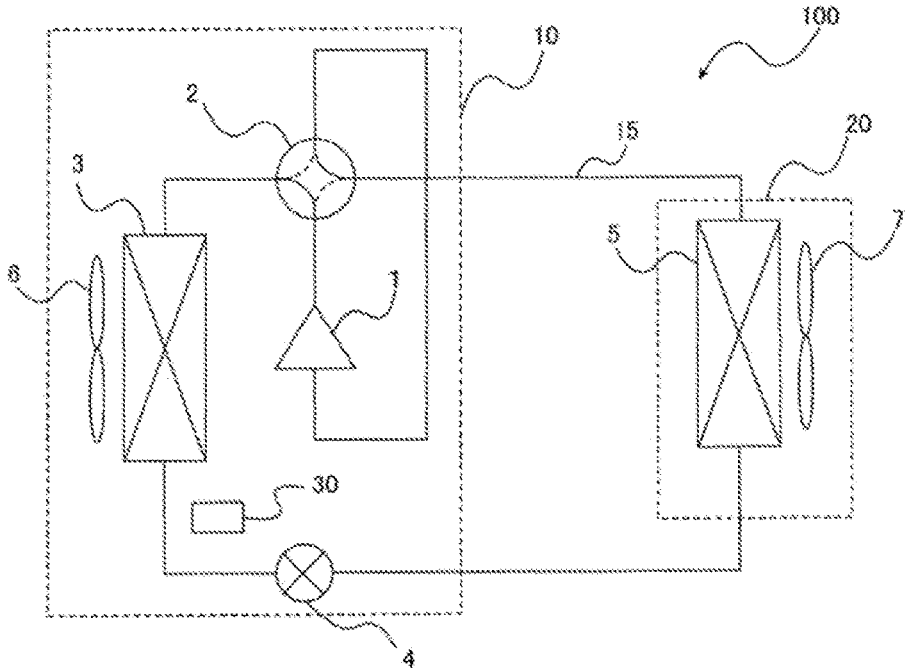
FIG. 1 is a diagram illustrating an example of the configuration of a refrigerant circuit of an air-conditioning apparatus according to Embodiment of the present invention.

FIG. 1 is a diagram illustrating an example of the configuration of a refrigerant circuit of an air-conditioning apparatus 100 according to Embodiment of the present invention. The air-conditioning apparatus 100 performs vapor-compression type refrigeration cycle operation and is thereby used for cooling or heating, for example, an air-conditioning target space.

As illustrated in FIG. 1, the air-conditioning apparatus 100 includes a heat source unit 10 configured to supply a heat source to a load-side unit 20, and the load-side unit 20 configured to perform cooling or heating of an air-conditioning target space by using the heat source supplied by the heat source unit 10.

The air-conditioning apparatus 100 includes a refrigerant circuit constituted by a compressor 1, a flow-path switching device 2, a first heat exchanger 3, a decompression device 4, and a second heat exchanger 5 that are connected to each other by a refrigerant pipe 15.

The compressor 1, the flow-path switching device 2, the first heat exchanger 3, and the decompression device 4 are mounted on the heat source unit 10. The second heat exchanger 5 is mounted on the load-side unit 20.

The air-conditioning apparatus 100 includes a controller 30 configured to control the entire apparatus.

The compressor 1 is constituted by, for example, an inverter compressor or other similar devices whose capacity is controllable. The compressor 1 suctions a gas refrigerant, compresses the gas refrigerant into a high-temperature-high-pressure state, and discharge the gas refrigerant.

The flow-path switching device 2 is for switching a refrigerant flow for heating operation and a refrigerant flow for cooling operation. That is, the flow-path switching device 2 is switched in heating operation to allow the compressor 1 and the second heat exchanger 5 to communicate with each other and switched in cooling operation to allow the compressor 1 and the first heat exchanger 3 to communicate with each other.

Preferably, the flow-path switching device 2 is constituted by, for example, a four-way valve. A combination of two-way valves or three-way valves may be employed as the flow-path switching device 2.

The first heat exchanger 3 is a heat source-side heat exchanger (outdoor heat exchanger). The first heat exchanger 3 serves as an evaporator in heating operation and serves as a condenser in cooling operation. That is, when functioning as an evaporator, the first heat exchanger 3 causes a low-temperature-low-pressure refrigerant flowing out of the decompression device 4 and air supplied by a fan 6 to exchange heat and causes a low-temperature-low-pressure liquid refrigerant (or a two-phase gas-liquid refrigerant) to evaporate. When functioning as a condenser, the first heat exchanger 3 causes a high-temperature, high-pressure refrigerant discharged from the compressor 1 and air supplied by the fan 6 to exchange heat and causes a high-temperature-high-pressure gas refrigerant to condense.

The first heat exchanger 3 may be constituted by, for example, a cross-fin tube type heat exchanger constituted by heat transfer tubes and a large number of fins.

The first heat exchanger 3 may be constituted by a refrigerant-water heat exchanger. In this case, in the first heat exchanger 3, heat is exchanged between refrigerant and a heat medium of water or other similar substances.

The decompression device 4 expands and decompresses refrigerant flowing out of the first heat exchanger 3 or the second heat exchanger 5. The decompression device 4 is desirably constituted by, for example, an electric expansion valve or other similar devices capable of adjusting the flow rate of refrigerant. Not only the electric expansion valve, a mechanical expansion valve that employs a diaphragm in a pressure reception portion, a capillary tube, or other similar devices are applicable as the decompression device 4.

The second heat exchanger 5 is a load-side heat exchanger (indoor heat exchanger). The second heat exchanger 5 serves as a condenser in heating operation and serves as an evaporator in cooling operation. That is, when functioning as a condenser, the second heat exchanger 5 causes a high-temperature, high-pressure refrigerant discharged from the compressor 1 and air supplied by a fan 7 to exchange heat and causes a high-temperature-high-pressure gas refrigerant to condense. When functioning as an evaporator, the second heat exchanger 5 causes a low-temperature-low-pressure refrigerant flowing out of the decompression device 4 and air supplied by the fan 7 to exchange heat and causes a low-temperature-low-pressure liquid refrigerant (or two-phase gas-liquid refrigerant) to evaporate.

The second heat exchanger 5 is, for example, a cross-fin tube type heat exchanger constituted by heat transfer tubes and a large number of fins.

The configuration of the second heat exchanger 5 will be described with reference to FIG. 2 and subsequent figures.

The controller 30 controls the driving frequency of the compressor 1 for required cooling capacity or heating capacity. The controller 30 also controls the opening degree of the decompression device 4 depending on an operation state and each mode. In addition, the controller 30 controls the flow-path switching device 2 depending on each mode. That is, the controller 30 is configured to control actuators (for example, the compressor 1, the decompression device 4, and the flow-path switching device 2) on the basis of an operational instruction from a user by utilizing information sent from each temperature sensor, not illustrated, and each pressure sensor, not illustrated.

The controller 30 may be constituted by hardware, such as a circuit device, that exerts the function thereof or may be constituted by an arithmetic unit, such as a micro-computer or a CPU, and software executed on the arithmetic unit.

<Operation of Air-Conditioning Apparatus 100>

Next, the operation of the air-conditioning apparatus 100 will be described with the flow of refrigerant. Here, the operation of the air-conditioning apparatus 100 will be described with an example in which a fluid that exchanges heat in the first heat exchanger 3 and the second heat exchanger 5 is air.

First, an operation mode that causes the first heat exchanger 3 to act as a condenser and the second heat exchanger 5 to act as an evaporator, that is, a cooling operation mode will be described.

The compressor 1 is driven to cause a high-temperature-high-pressure gas state refrigerant to be discharged from the compressor 1. The high-temperature-high-pressure gas refrigerant (single phase) discharged from the compressor 1 flows into the first heat exchanger 3 that serves as a condenser. In the first heat exchanger 3, heat is exchanged between the flowed-in high-temperature-high-pressure gas refrigerant and air supplied by the fan 6, and the high-temperature-high-pressure gas refrigerant condenses into a high-pressure liquid refrigerant (single phase).

The high-pressure liquid refrigerant sent out from the first heat exchanger 3 is expanded by the decompression device 4 to be two-phase state refrigerant containing low-pressure gas refrigerant and liquid refrigerant. The two-phase state refrigerant flows into the second heat exchanger 5 that serves as an evaporator. In the second heat exchanger 5, heat is exchanged between the flowed-in two-phase state refrigerant and air supplied by the fan 7, the liquid refrigerant of the two-phase state refrigerant evaporates, and the two-phase state refrigerant becomes a low-pressure gas refrigerant (single phase). The low-pressure gas refrigerant sent out from the second heat exchanger 5 flows into the compressor 1 via the flow-path switching device 2, is compressed into a high-temperature-high-pressure gas refrigerant, and discharged again from the compressor 1. Subsequently, this cycle is repeated.

Next, an operation mode that causes the first heat exchanger 3 to act as an evaporator and the second heat exchanger 5 to act as a condenser, that is, a heating operation mode will be described.

The compressor 1 is driven to cause a high-temperature-high-pressure gas state refrigerant to be discharged from the compressor 1. The high-temperature-high-pressure gas state refrigerant (single phase) discharged from the compressor 1 flows into the second heat exchanger 5 that serves as a condenser. In the second heat exchanger 5, heat is exchanged between the flowed-in high-temperature-high-pressure gas refrigerant and air supplied by the fan 7, and the high-temperature-high-pressure gas refrigerant condenses into a high-pressure liquid refrigerant (single phase).

The high-pressure liquid refrigerant sent out from the second heat exchanger 5 is caused by the decompression device 4 to be two-phase state refrigerant containing low-pressure gas refrigerant and liquid refrigerant. The two-phase state refrigerant flows into the first heat exchanger 3 that serves as an evaporator. In the first heat exchanger 3, heat is exchanged between the flowed-in two-phase state refrigerant and air supplied by the fan 6, the liquid refrigerant of the two-phase state refrigerant evaporates, and the two-phase state refrigerant becomes a low-pressure gas refrigerant (single phase). The low-pressure gas refrigerant sent out from the first heat exchanger 3 flows into the compressor 1 via the flow-path switching device 2, is compressed into a high-temperature-high-pressure gas refrigerant, and discharged again from the compressor 1. Subsequently, this cycle is repeated.

Figure 2:
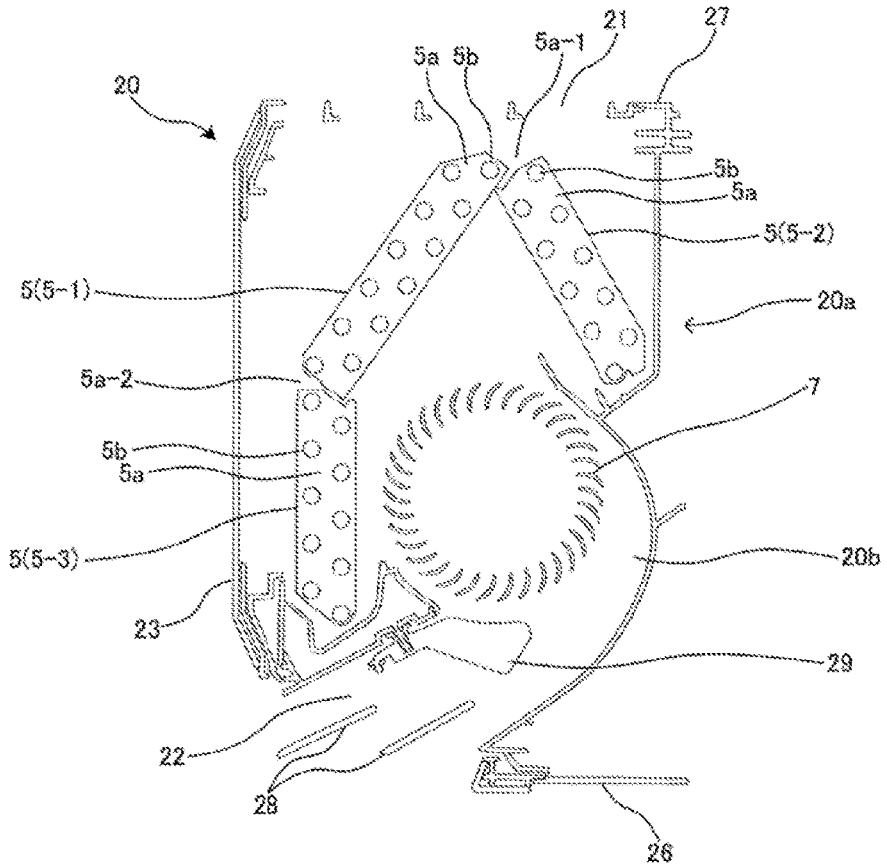
FIG. 2 is a schematic view schematically illustrating an example of the internal configuration of a load-side unit of the air-conditioning apparatus according to Embodiment of the present invention.

FIG. 2 is a schematic view schematically illustrating an example of the internal configuration of the load-side unit 20 of the air-conditioning apparatus 100. On the basis of FIG. 2, the configuration of the load-side unit 20 will be described. FIG. 2 illustrates an example in which the load-side unit 20 is an indoor unit.

The load-side unit 20 is installed in a space (for example, an indoor air-conditioning target space or another space connected to the air-conditioning target space via a duct or a similar component) from which cooling energy or heating energy can be supplied to an air-conditioning target space and has a function of cooling or heating the air-conditioning target space by using the cooling energy or the heating energy supplied from the heat source unit 10.

The load-side unit 20 includes a casing 20*a* that has a laterally-long cuboid shape.

The front surface of the casing 20*a* has an opening portion, and the opening portion of the front surface is covered by a front panel 23. The left and right side surfaces of the casing 20*a* are covered by side panels (not illustrated). The rear surface of the casing 20*a* is covered by a rear panel (not illustrated). The lower surface of the casing 20*a* is covered by the rear panel, a lower panel 26, and up-down airflow direction louvers 28. The top surface of the casing 20*a* is covered by a top panel 27.

The shape of the casing 20*a* is not limited to the laterally-long cuboid shape.

The top panel 27 includes a grating-shaped opening portion, and the opening portion serves as an air inlet 21.

The front panel 23 constitutes a front-side design surface of the load-side unit 20. The front panel 23 has a structure that enables the front surface of the casing 20*a* to be opened or closed.

A portion of the casing 20*a* covered by the up-down airflow direction louvers 28 has an opening, and the opening serves as an air outlet 22.

The second heat exchanger 5 (indoor heat exchanger) and the fan 7 are installed inside the casing 20*a*.

The second heat exchanger 5 is disposed upstream of the fan 7. The fan 7 is configured to generate an air flow by driving a motor, not illustrated. The fan 7 is disposed downstream of the second heat exchanger 5. Specifically, the second heat exchanger 5 is disposed upstream of the fan 7 so as to surround the fan 7, and heat is exchanged between a refrigerant crossflow in the refrigerant circuit and indoor air supplied by the fan 7. As illustrated in FIG. 2, the fan 7 may be constituted by, for example, a crossflow fan.

It is preferable that a filter that catches dust contained in air that has flowed in from the air inlet 21 be disposed upstream of the second heat exchanger 5 in the casing 20*a*.

As illustrated in FIG. 2, the casing 20*a* includes an air passage 20*b* through which the air inlet 21 and the air outlet 22 communicate with each other.

The up-down airflow direction louvers 28 are disposed in the air outlet 22. Left-right airflow direction louvers 29 are disposed in the air passage 20*b* running from the fan 7 to the air outlet 22.

The up-down airflow direction louvers 28 adjust, in the up-down direction, the wind direction of air blown out from the air outlet 22 and are configured to close the air outlet 22 during non-operation and additionally function as a design surface of a lower surface portion of the load-side unit 20.

The left-right airflow direction louvers 29 are disposed upstream of the up-down airflow direction louvers 28 and adjust, in the left-right direction, the wind direction of air blown out from the air outlet 22.

The second heat exchanger 5 includes a plurality of plate-shaped fins 5*a* each being elongate in a longitudinal direction and a plurality of heat transfer tubes 5*b* passing through the fins 5*a*. The second heat exchanger 5 is constituted by a plurality of heat exchanging units isolated from each other in the longitudinal direction of the fins 5*a*. FIG. 2 illustrates an example in which the second heat exchanger 5 is constituted by three heat exchanging units isolated from each other. In FIG. 2, the isolated upper left portion is referred to as an upper-left heat exchanging unit 5-1, the isolated upper right portion is referred to as an upper-right heat exchanging unit 5-2, and the isolated lower portion is referred to as a lower heat exchanging unit 5-3.

A boundary portion between the upper-left heat exchanging unit 5-1 and the upper-right heat exchanging unit 5-2 is referred to as a boundary portion 5*a*-1, and a boundary portion between the upper-left heat exchanging unit 5-1 and the lower heat exchanging unit 5-3 is referred to as a boundary portion 5*a*-2. Three or more of boundary portions may be provided, and the number of isolated heat exchanging units constituting the second heat exchanger 5 may be three or more. For example, the number of isolated heat exchanging units may be determined depending on the arrangement, the size, and the like of the second heat exchanger 5 inside the casing 20*a*.

The boundary portions may be formed by combining and disposing, as illustrated in FIG. 2, the upper-left heat exchanging unit 5-1, the upper-right heat exchanging unit 5-2, and the lower heat exchanging unit 5-3 that have been formed in isolation from each other. Alternatively, the upper-left heat exchanging unit 5-1, the upper-right heat exchanging unit 5-2, and the lower heat exchanging unit 5-3 may be constituted by the same fins 5*a*, and portions of the fins 5*a* may be folded and bent to be arranged as illustrated in FIG. 2. In this case, the folded and bent portions of the fins 5*a* serve as boundary portions.

Figure 3:
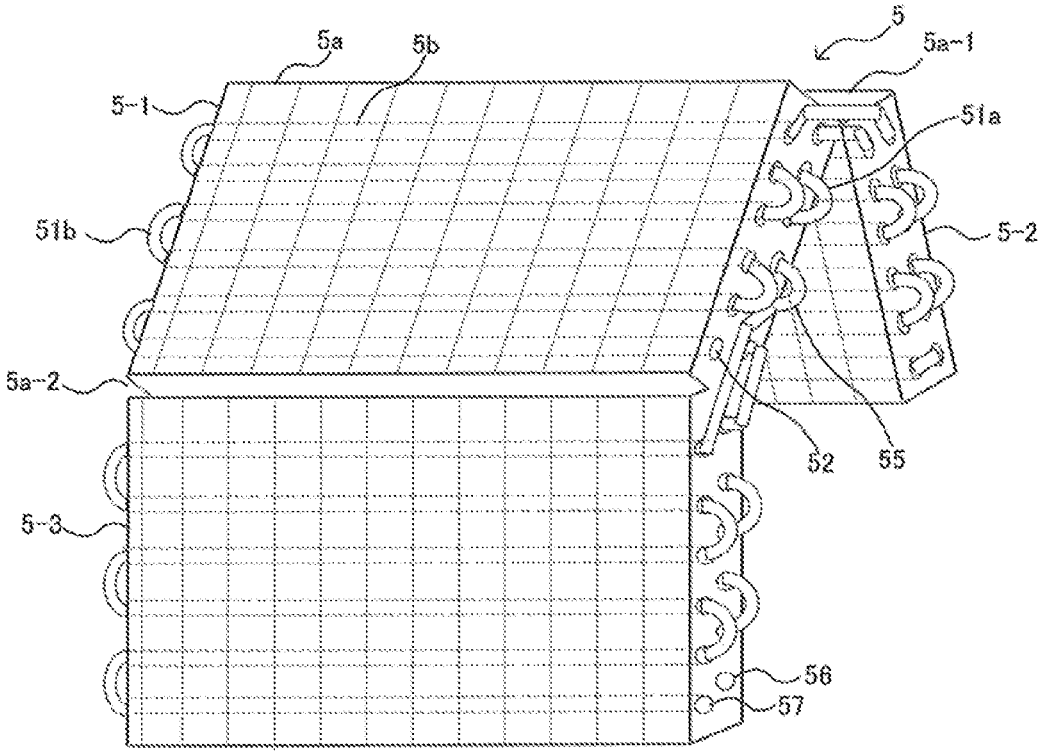
FIG. 3 is a perspective view schematically illustrating the configuration of a heat exchanger according to Embodiment of the present invention.
Figure 4:
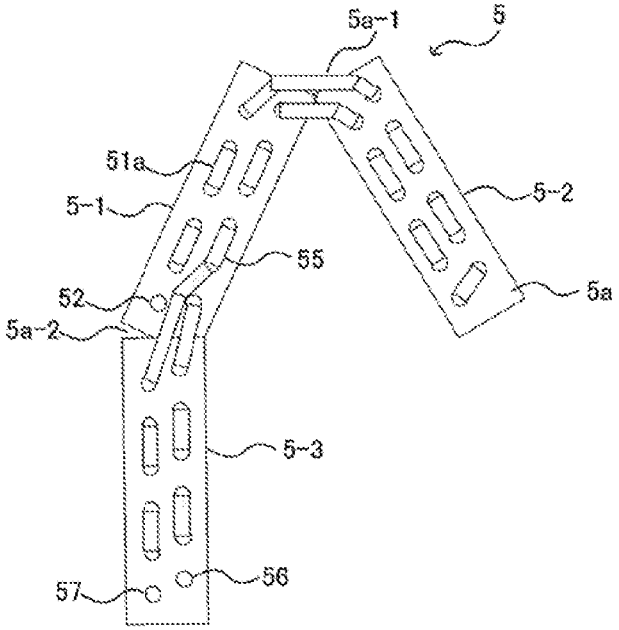
FIG. 4 is a side view schematically illustrating the configuration of the heat exchanger according to Embodiment of the present invention.

FIG. 3 is a perspective view schematically illustrating the configuration of a heat exchanger according to Embodiment of the present invention. FIG. 4 is a side view schematically illustrating the configuration of the heat exchanger according to Embodiment of the present invention. The heat exchanger illustrated in FIG. 3 and FIG. 4 is an example of the second heat exchanger 5 illustrated in FIG. 1. On the basis of FIG. 3 and FIG. 4, the heat exchanger according to Embodiment of the present invention, that is, the specific configuration of the second heat exchanger 5, will be described.

The second heat exchanger 5 is a fin-and-tube heat exchanger that includes the plurality of plate-shaped fins 5*a* arranged with spacing from each other, the plurality of heat transfer tubes 5*b* passing through the plurality of fins 5*a* and in which refrigerant flows, and a distributor 55 that distributes the refrigerant to two heat transfer tubes 5*b*.

The fins 5*a* are each constituted by a rectangular plate-shaped member that is elongate in a longitudinal direction thereof in a side view in which the second heat exchanger 5 is viewed from the side. The fins 5*a* are made of, for example, aluminum.

The heat transfer tubes 5*b* are, for example, round tubes or flat pipes made of copper or aluminum. The heat transfer tubes 5*b* pass through the fins 5*a* so as to run in the left-right direction of the second heat exchanger 5. The distributor 55 is connected at one end of some of the heat transfer tubes 5*b*, U-bent portions 51*a* are connected at one end of the rest of heat transfer tubes 5*b*, and U-bent portions 51*b* are connected at the other end of all of the plurality of heat transfer tubes 5*b*.

When the second heat exchanger 5 serves as an evaporator, a two-phase gas-liquid state refrigerant is required to be branched evenly to each of the heat transfer tubes 5*b* of the second heat exchanger 5. In general, refrigerant at an inlet of an evaporator is in a two-phase gas-liquid state containing gas refrigerant and liquid refrigerant, and there is density distribution in the cross-section of refrigerant flowing inside a pipe. For example, when a pipe is bent, an uneven flow phenomenon in which a liquid refrigerant flows unevenly toward a tube inner surface on one side due to the effect of centrifugal force is caused. That is, the two-phase gas-liquid refrigerant is separated into gas and liquid. In an evaporator, it is preferable that a distributor having a distributing function that suppresses gas-liquid separation generated due to an uneven flow phenomenon be included.

Thus, the second heat exchanger 5 includes the distributor 55 so that refrigerant is evenly distributed to, from among the heat transfer tubes 5*b*, two heat transfer tubes 5*b* not adjacent to each other. Specifically, as illustrated in FIG. 3 and FIG. 4, the distributor 55 is configured to distribute refrigerant to two heat transfer tubes 5*b* disposed in different heat exchanging units. FIG. 3 illustrates an example in which the distributor 55 distributes refrigerant to the heat transfer tube 5*b* of the upper-left heat exchanging unit 5-1 and the heat transfer tube 5*b* of the lower heat exchanging unit 5-3.

Figure 5:
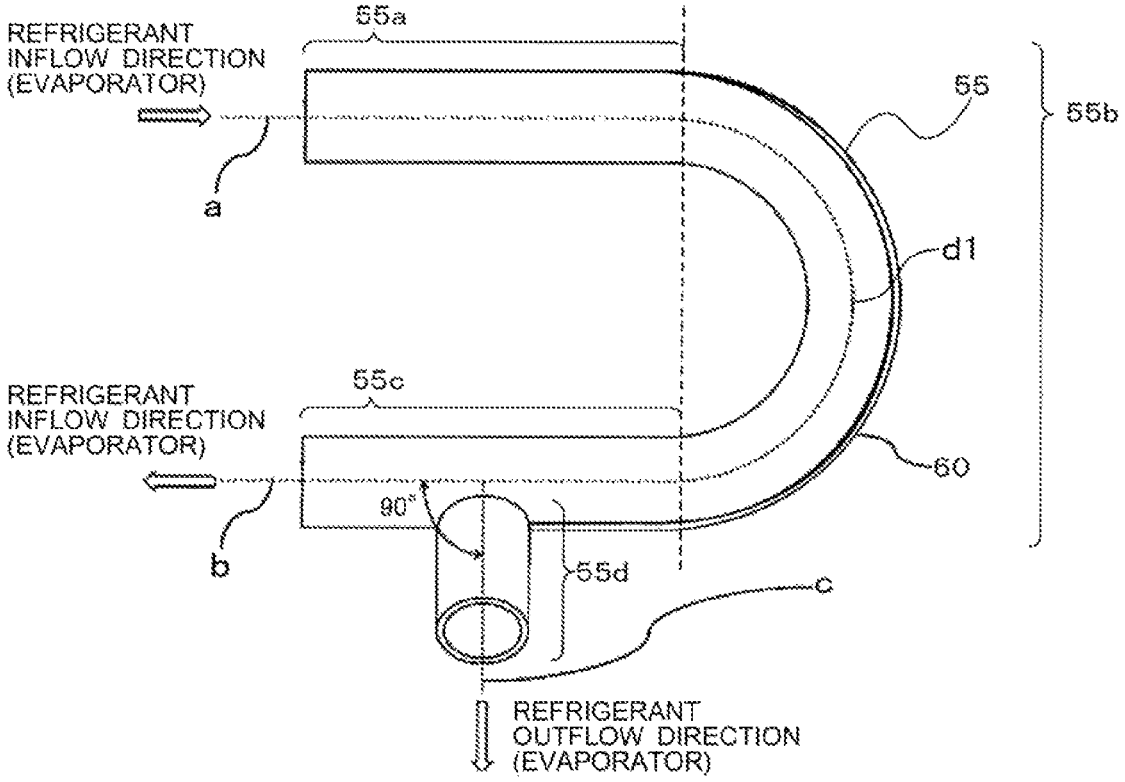
FIG. 5 is a plan view schematically illustrating the configuration of a distributor included in the heat exchanger according to Embodiment of the present invention.
Figure 6:
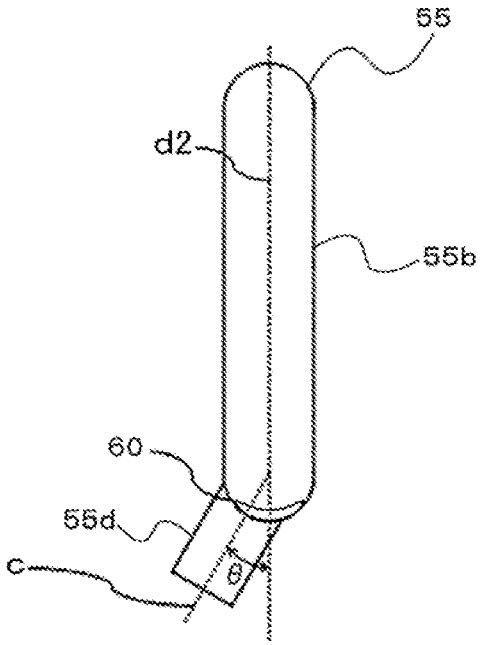
FIG. 6 is a side view schematically illustrating the configuration of the distributor included in the heat exchanger according to Embodiment of the present invention.
Figure 7:
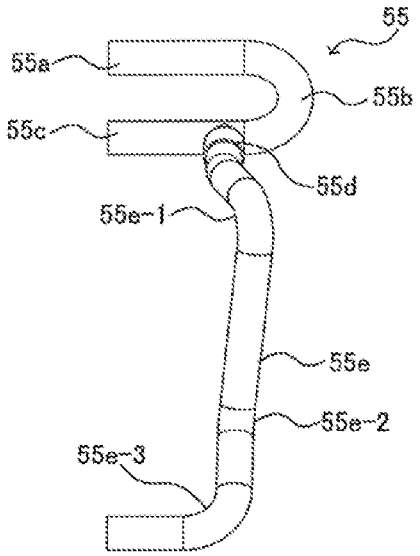
FIG. 7 illustrates an example of the specific configuration of the distributor included in the heat exchanger according to Embodiment of the present invention, the example being viewed in a predetermined direction.
Figure 8:
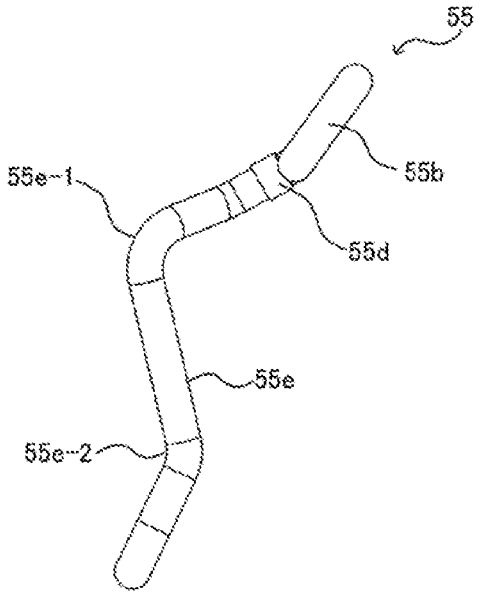
FIG. 8 illustrates the example of the specific configuration of the distributor included in the heat exchanger according to Embodiment of the present invention, the example being viewed in a direction different from the direction in FIG. 7.
Figure 9:
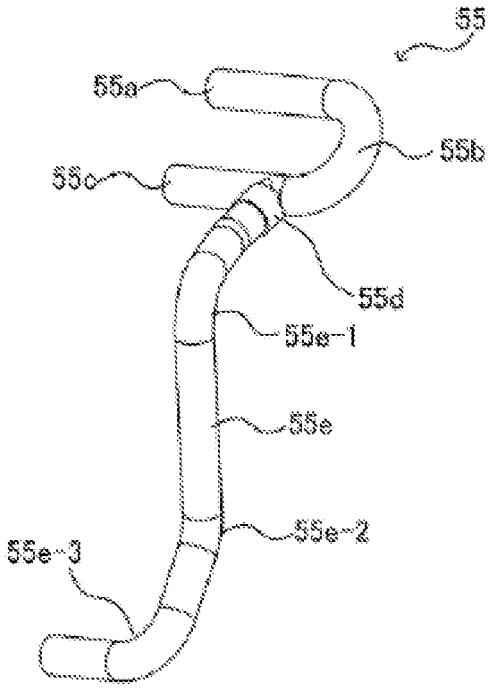
FIG. 9 illustrates the example of the specific configuration of the distributor included in the heat exchanger according to Embodiment of the present invention, the example being viewed in another direction different from the direction in FIG. 7.

FIG. 5 is a plan view schematically illustrating the configuration of the distributor 55 included in the heat exchanger according to Embodiment of the present invention. FIG. 6 is a side view schematically illustrating the configuration of the distributor 55 included in the heat exchanger according to Embodiment of the present invention. FIG. 7 illustrates an example of the specific configuration of the distributor 55 included in the heat exchanger according to Embodiment of the present invention, example being viewed in a predetermined direction. FIG. 8 illustrates the example of the specific configuration of the distributor 55 included in the heat exchanger according to Embodiment of the present invention, the example being viewed in a direction different from the direction in FIG. 7. FIG. 9 illustrates the example of the specific configuration of the distributor 55 included in the heat exchanger according to Embodiment of the present invention, the example being viewed in another direction different from the direction in FIG. 7. On the basis of FIG. 5 to FIG. 9, the distributor 55 will be described in detail.

As illustrated in FIG. 5, with the flow of refrigerant when the second heat exchanger 5 serves as an evaporator, the distributor 55 includes an inflow portion 55*a*, a turn-back portion 55*b*, a first outflow portion 55*c*, a second outflow portion 55*d*, and a connection pipe 55*e*.

The inflow portion 55*a* has a linear shape and is connected to one of the heat transfer tubes 5*b* to serve as an inlet portion for refrigerant.

The turn-back portion 55*b* is continuous with the inflow portion 55*a* and folded and bent in a U-shape.

The first outflow portion 55*c* is continuous with the turn-back portion 55*b*, has a linear shape running in parallel to the inflow portion 55*a*, and serves as one of outlet portions for refrigerant.

The second outflow portion 55*d* is continuous with the first outflow portion 55*c*, has a linear shape branching from the first outflow portion 55*c*, and serves as one of the outlet portions for refrigerant.

The connection pipe 55*e* is continuous with the second outflow portion 55*d* and includes a plurality of bent portions.

That is, the distributor 55 is configured such that the inflow portion 55*a*, the turn-back portion 55*b*, the first outflow portion 55*c*, the second outflow portion 55*d*, and the connection pipe 55*e* are in communication with each other, and refrigerant that has flowed in from the inflow portion 55*a* is distributed to the first outflow portion 55*c* and the second outflow portion 55*d* after flowing through the turn-back portion 55*b* and flows out. In addition, the refrigerant that is distributed to the second outflow portion 55*d* flows through the connection pipe 55*e* and is guided into the heat transfer tube 5*b* not adjacent to the heat transfer tube 5*b* to which the first outflow portion 55*c* is connected.

Here, a virtual straight line connecting the axial centers at the two ends of the inflow portion 55*a* is defined as a pipe axis a, a virtual straight line connecting the axial centers at the two ends of the first outflow portion 55*c* is defined as a pipe axis b, a virtual straight line connecting the axial centers at the two ends of the second outflow portion 55*d* is defined as a pipe axis c, and a curved line connecting the axial centers at the two ends of the turn-back portion 55*b* is defined as a pipe axis d1. In a side view in which the turn-back portion 55*b* is viewed from the side, a virtual straight line connecting the axial centers at the two ends of the turn-back portion 55*b* is defined as a pipe axis d2. The view in which the turn-back portion 55*b* is viewed from the side means a view in which the distributor 55 is viewed in the flow direction of refrigerant in the inflow portion 55*a* and the first outflow portion 55*c*.

The distributor 55 is configured such that the pipe axis c is orthogonal to the pipe axis b and that the pipe axis c and the pipe axis d2 form an angle θ. Moreover, the distributor 55 is configured such that, when the distributor 55 is disposed in a usable state, the pipe axis d2 is at an inclination relative to the vertical direction. A possible range of the angle θ is 0<θ<90°.

Figure 10:
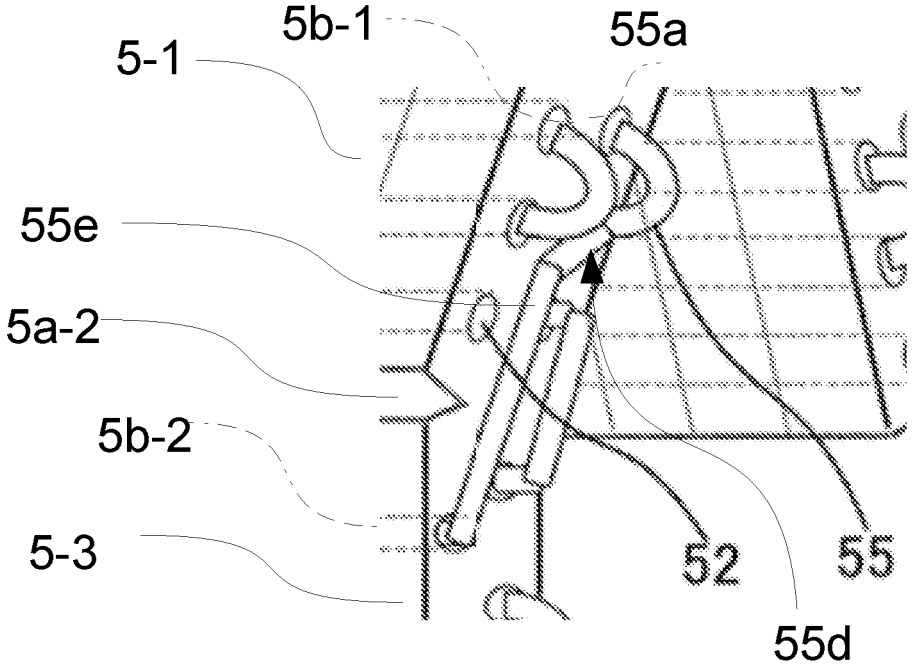
FIG. 10 illustrates a closeup of FIG. 3.

The connection pipe 55*e* is connected to the second outflow portion 55*d* so as to be continuous therewith. The connection pipe 55*e* is folded and bent at a plurality of portions. In FIG. 6 to FIG. 9, a bent portion 55*e*-1, a bent portion 55*e*-2, and a bent portion 55*e*-3 are illustrated in this order from a portion closer to the second outflow portion 55*d*. Due to the provision of the connection pipe 55*e*, the distributor 55 can distribute refrigerant to two heat transfer tubes 5*b* (5*b*-1, 5*b*-2 in FIG. 10) not adjacent to each other. Specifically, the distributor 55 can distribute refrigerant that flows out from the second outflow portion 55*d*, not to the upper-left heat exchanging unit 5-1, but to the lower heat exchanging unit 5-3, which is partitioned by the boundary portion 5*a*-2.

For example, when the distributor 55 is disposed at the upper-right heat exchanging unit 5-2, the distributor 55 can distribute refrigerant that flows out from the second outflow portion 55*d*, not to the upper-right heat exchanging unit 5-2, but to the upper-left heat exchanging unit 5-1 partitioned by the boundary portion 5*a*-1 or to the lower heat exchanging unit 5-3 partitioned by the boundary portion 5*a*-2.

When the distributor 55 is disposed at the lower heat exchanging unit 5-3, the distributor 55 can distribute refrigerant that flows out from the second outflow portion 55*d*, not to the lower heat exchanging unit 5-3, but to the upper-left heat exchanging unit 5-1 partitioned by the boundary portion 5*a*-2 or to the upper-right heat exchanging unit 5-2 partitioned by the boundary portion 5*a*-1 and the boundary portion 5*a*-2.

That is, due to the connection pipe 55*e* including the plurality of bent portions being connected to the second outflow portion 55*d*, the distributor 55 can distribute refrigerant flowing out of the second outflow portion 55*d* to the heat transfer tube 5*b* not adjacent to the heat transfer tube 5*b* connected to the first outflow portion 55*c*. Thus, the second heat exchanger 5 requires a less pipe handling space and does not increase the size of the load-side unit 20 on which the second heat exchanger 5 is mounted. Moreover, the distribution amount of refrigerant is properly adjusted by the distributor 55, which reduces unevenness in heat exchanging efficiency among the heat exchanging units. That is, it is possible to improve the heat exchanging efficiency of the entire second heat exchanger 5.

The number of the bent portions included in the connection pipe 55*e* is not particularly limited as long as a plurality of the bent portions are provided. The bent angle of each bent portion is also not particularly limited and may be determined depending on handling of the pipes including the connection pipe 55*e*. Moreover, the length of the connection pipe 55*e* is not particularly limited and may be determined depending on the location of the heat transfer tube 5*b* to which the connection pipe 55*e* is connected.

The flow of refrigerant when the second heat exchanger 5 including the thus configured distributor 55 serves as an evaporator will be described.

A two-phase gas-liquid refrigerant that has passed through the decompression device 4 flows into the second heat exchanger 5. In the second heat exchanger 5, the refrigerant flows from a refrigerant inlet 52 disposed at one end of the upper-left heat exchanging unit 5-1 into the heat transfer tubes 5*b* constituting the upper-left heat exchanging unit 5-1. The refrigerant that has flowed into the upper-left heat exchanging unit 5-1 flows toward the other end of the upper-left heat exchanging unit 5-1, turns back at the U-bent portions 51*b*, and returns to the one end of the upper-left heat exchanging unit 5-1.

After reciprocating a plurality of times between the one end and the other end of the upper-left heat exchanging unit 5-1, the refrigerant flows into the upper-right heat exchanging unit 5-2 via, for example, the heat transfer tube 5*b* located at the uppermost part. The refrigerant that has flowed into the upper-right heat exchanging unit 5-2 flows toward the other end of the upper-right heat exchange unit 5-2, turns back at the U-bent portions 51*b*, and returns to the one end of the upper-right heat exchanging unit 5-2. After reciprocating a plurality of times between the one end and the other end of the upper-right heat exchanging unit 5-2, the refrigerant flows into the upper-left heat exchanging unit 5-1 via, for example, the heat transfer tube 5*b* located at one step lower than the uppermost part.

After reciprocating a plurality of times between the one end and the other end of the upper-left heat exchanging unit 5-1, the refrigerant flows into the distributor 55 from the inflow portion 55*a* of the distributor 55 disposed at the one end of the upper-left heat exchanging unit 5-1. The refrigerant that has flowed in from the inflow portion 55*a* of the distributor 55 turns back at the turn-back portion 55*b* in the angle of 180°. Due to centrifugal force acting at the turn-back portion 55*b*, the refrigerant is distributed unevenly toward an outer circumference part. That is, as illustrated in FIG. 5, a refrigerant uneven distribution portion 60 is generated. Thus, in the distributor 55, the amount of refrigerant that flows along the outer circumference part of the turn-back portion 55*b* and flows to the second outflow portion 55*d* is adjustable by adjusting the angle θ, which is an angle formed by the pipe axis c and the pipe axis d2, within the range of 0<θ<90°.

For example, when θ=0°, the area of the second outflow portion 55*d* occupying the outer circumference side continuous from the turn-back portion 55*b* is large, and the ratio of a refrigerant that flows to the second outflow portion 55*d* thus is large compared to a refrigerant that flows to the first outflow portion 55*c*. As θ becomes large, the area of the second outflow portion 55*d* occupying the outer circumference side continuous from the turn-back portion 55*b* becomes small, and the ratio of the refrigerant that flows to the first outflow portion 55*c* thus becomes large compared to the refrigerant that flows to the second outflow portion 55*d*.

After flowing toward the other end of the upper-left heat exchanging unit 5-1, the refrigerant that has flowed out from the first outflow portion 55*c* with the distribution amount thereof being adjusted by the distributor 55 flows into the lower heat exchanging unit 5-3. After reciprocating a plurality of times between the one end and the other end of the lower heat exchanging unit 5-3, the refrigerant that has flowed into the lower heat exchanging unit 5-3 flows from a first refrigerant outlet 56 disposed at the one end of the lower heat exchanging unit 5-3 to outside the second heat exchanger 5.

Meanwhile, the refrigerant that has flowed out from the second outflow portion 55*d* with the distribution amount thereof being adjusted by the distributor 55 is guided to the lower heat exchanging unit 5-3, flows toward the other end of the lower heat exchanging unit 5-3, turns back at the U-bent portions 51*b*, and returns to the one end of the lower heat exchanging unit 5-3. After reciprocating a plurality of times between the one end and the other end of the lower heat exchanging unit 5-3, the refrigerant flows from a second refrigerant outlet 57 disposed at the one end of the lower heat exchanging unit 5-3 to outside the second heat exchanger 5.

As described above, due to the provision of the connection pipe 55*e*, the distributor 55 can, even having a size similar to the size of a commonly used U-shaped turn-back pipe, distribute refrigerant at any refrigerant distribution amount in two directions by adjusting the angle θ. Therefore, the distributor 55 can distribute refrigerant in a reduced space and improving the heat exchanging efficiency of the second heat exchanger 5 in which the distributor 55 is disposed.

In actual use, as illustrated in FIG. 3 and FIG. 4, the connection pipe 55*e* is attached to the leading end of the second outflow portion 55*d* and connected to the heat transfer tube 5*b* that is not adjacent to the heat transfer tube 5*b* to which the first outflow portion 55*c* is connected. The location of the heat transfer tube 5*b* to which the connection pipe 55*e* is connected is not particularly limited as long as the heat transfer tube 5*b* is not adjacent to the heat transfer tube 5*b* to which the first outflow portion 55*c* is connected.

As described above, the second heat exchanger 5 includes the plate-shaped fins 5*a* each being elongate in the longitudinal direction, the plurality of heat transfer tubes 5*b* passing through the fins 5*a*, and the distributor 55 that distributes refrigerant to, from among the plurality of heat transfer tubes 5*b*, two heat transfer tubes 5*b*. The distributor 55 includes the inflow portion 55*a* being linear and connected to one of the plurality of heat transfer tubes 5*b*, the turn-back portion 55*b* continuous with the inflow portion 55*a*, the first outflow portion 55*c* being linear, continuous with the turn-back portion 55*b* and running in parallel to the inflow portion 55*a*, the second outflow portion 55*d* being linear, continuous with the turn-back portion 55*b* and branching from the first outflow portion 55*c*, and the connection pipe 55*e* continuous with the second outflow portion 55*d* and including the plurality of bent portions. The second outflow portion 55*d* is connected via the connection pipe 55*e* to the heat transfer tube 5*b* that is not adjacent to the heat transfer tube 5*b* connected to the first outflow portion 55*c*.

Thus, due to the provision of the distributor 55 that includes the connection pipe 55*e*, the second heat exchanger 5 requires a less pipe handling space and is capable of properly adjusting the distribution amount of refrigerant.

The second heat exchanger 5 is constituted by the plurality of heat exchanging units (for example, the upper-left heat exchanging unit 5-1, the upper-right heat exchanging unit 5-2, and the lower heat exchanging unit 5-3) isolated from each other in the longitudinal direction of the fins 5*a*. The distributor 55 is for distributing refrigerant to the heat exchanging units different from each other.

Thus, the second heat exchanger 5 can reduce unevenness in the heat exchanging efficiency among the heat exchanging units and improve the heat exchanging efficiency of the entire second heat exchanger 5.

In the distributor 55 of the second heat exchanger 5, the pipe axis c connecting the axial centers at the two ends of the second outflow portion 55*d* is orthogonal to the pipe axis b connecting the axial centers at the two ends of the first outflow portion 55*c*, and the pipe axis c connecting the axial centers at the two ends of the second outflow portion 55*d* and the pipe axis d2 connecting the axial centers at the two ends of the turn-back portion 55*b* in a side view in which the turn-back portion 55*b* is viewed from the side form the angle θ.

Thus, due to the provision of the distributor 55 in which the pipe axis c and the pipe axis d2 form the angle θ, the second heat exchanger 5 enables the distributor 55 to be designed by adjusting the angle thereof for a location to which the distributor 55 is attached, which enables refrigerant to be distributed at a target distribution ratio even with space restriction.

In the second heat exchanger 5, when the distributor 55 is disposed in a usable state, the pipe axis d2 connecting the axial centers at the two ends of the turn-back portion 55*b* is at an inclination relative to the vertical direction in a side view in which the turn-back portion 55*b* is viewed from the side.

Thus, due to the pipe axis d2 inclining relative to the vertical direction, the second heat exchanger 5 enables the distributor 55 to be designed by adjusting the angle thereof for a location to which the distributor 55 is attached, which enables refrigerant to be distributed at a target distribution ratio even with space restriction.

The air-conditioning apparatus 100 uses the aforementioned heat exchanger as an indoor heat exchanger.

Thus, the air-conditioning apparatus 100 does not increase the size of the load-side unit 20 as a result of installation of the second heat exchanger 5 and improves the heat exchanging efficiency due to the provision of the second heat exchanger 5.

The above is description of Embodiment of the present invention; however, the present invention is not limited to the configuration of Embodiment described above. Various modifications or combinations within the range of the technical concept of the present invention are possible.

The invention claimed is:

1. A heat exchanger comprising:

a plate-shaped fin being elongate in a longitudinal direction thereof;

a plurality of heat transfer tubes passing through the plate-shaped fin; and a distributor configured to distribute refrigerant to two of the heat transfer tubes, the distributor including an inflow portion being linear and connected to a first heat transfer tube of the heat transfer tubes, a turn-back portion continuous with the inflow portion, a first outflow portion being linear, continuous with the turn-back portion and running in parallel to the inflow portion, a second outflow portion being linear, continuous with the first outflow portion and branching from the first outflow portion, and a connection pipe continuous with the second outflow portion and including a plurality of bent portions, the second outflow portion being connected via the connection pipe to a second heat transfer tube of the heat transfer tubes, the second heat transfer tube being not adjacent to the first heat transfer tube, wherein, in the distributor, a virtual straight line connecting axial centers at two ends of the second outflow portion is orthogonal to a virtual straight line connecting axial centers at two ends of the first outflow portion, and in a side view of the turn-back portion, wherein the side view means that the distributor is viewed in a flow direction of the inflow portion and the first outflow portion:

the virtual straight line connecting the axial centers at the two ends of the second outflow portion and a virtual straight line connecting axial centers at two ends of the turn-back portion form an angle θ.

2. The heat exchanger of claim 1, wherein the heat exchanger is constituted by a plurality of heat exchanging units isolated from each other in the longitudinal direction of the plate-shaped fin, and wherein the distributor is configured to distribute refrigerant to the heat exchanging units different from each other.

3. The heat exchanger of claim 1, wherein, when the distributor is disposed in a usable state in which the distributor is capable of being used, the virtual straight line connecting the axial centers at the two ends of the turn-back portion is at an inclination relative to a vertical direction in the side view of the turn-back portion.

4. The air-conditioning apparatus of claim 1, wherein a possible range of the angle θ is $0<\theta<90°$.

5. An air-conditioning apparatus comprising:

a refrigerant circuit including a compressor, an outdoor heat exchanger, and an indoor heat exchanger, the indoor heat exchanger comprising:

a plate-shaped fin being elongate in a longitudinal direction thereof;

a plurality of heat transfer tubes passing through the plate-shaped fin; and a distributor configured to distribute refrigerant to two of the heat transfer tubes, the distributor including an inflow portion being linear and connected to a first heat transfer tube of the heat transfer tubes, a turn-back portion continuous with the inflow portion, a first outflow portion being linear, continuous with the turn-back portion and running in parallel to the inflow portion, a second outflow portion being linear, continuous with the first outflow portion and branching from the first outflow portion, and a connection pipe continuous with the second outflow portion and including a plurality of bent portions, the second outflow portion being connected via the connection pipe to a second heat transfer tube of the heat transfer tubes, the second heat transfer tube being not adjacent to the first heat transfer tube, wherein, in the distributor, a virtual straight line connecting axial centers at two ends of the second outflow portion is orthogonal to a virtual straight line connecting axial centers at two ends of the first outflow portion, and in a side view of the turn-back portion, wherein the side view means that the distributor is viewed in a flow direction of the inflow portion and the first outflow portion:

the virtual straight line connecting the axial centers at the two ends of the second outflow portion and a virtual straight line connecting axial centers at two ends of the turn-back portion form an angle θ.

* * * * *